US009993912B2

(12) United States Patent
Lee

(10) Patent No.: US 9,993,912 B2
(45) Date of Patent: Jun. 12, 2018

(54) NAIL PUSHING DEVICE FOR NAIL GUN

(71) Applicant: Samson Power Tool Co. Ltd., Taichung (TW)

(72) Inventor: Yi-Kuan Lee, Taichung (TW)

(73) Assignee: Samson Power Tool Co. Ltd., Taichung (TW)

( * ) Notice: Subject to any disclaimer, the term of this patent is extended or adjusted under 35 U.S.C. 154(b) by 441 days.

(21) Appl. No.: 14/870,482

(22) Filed: Sep. 30, 2015

(65) Prior Publication Data

US 2017/0087698 A1 Mar. 30, 2017

(51) Int. Cl.
*B25C 5/16* (2006.01)
*B25C 1/00* (2006.01)

(52) U.S. Cl.
CPC ..... *B25C 5/1617* (2013.01); *B25C 1/005* (2013.01)

(58) Field of Classification Search
CPC ..... B25C 5/16; B25C 5/1617; B25C 5/1641; B25C 5/1658; B25C 1/001; B25C 1/005
USPC ..... 227/109
See application file for complete search history.

(56) References Cited

U.S. PATENT DOCUMENTS 4,174,802 A * 11/1979 Maestri ..... B25C 1/005 206/338
4,524,896 A * 6/1985 Morrell, Jr. ..... B25C 5/16 227/126
4,815,647 A * 3/1989 Chou ..... B25C 1/005 227/109
5,368,213 A * 11/1994 Massari, Jr. ..... B25C 1/005 227/120
5,522,533 A * 6/1996 Mukoyama ..... B25C 1/005 227/109
5,632,431 A * 5/1997 Lin ..... B25C 1/005 227/109
5,653,371 A * 8/1997 Hou ..... B25C 1/005 227/109
5,743,453 A * 4/1998 Chuang ..... B25C 5/1658 227/109
5,813,588 A * 9/1998 Lin ..... B25C 1/005 227/109
6,092,711 A * 7/2000 Tinarelli ..... B25C 5/1658 227/109
6,398,097 B1 * 6/2002 Liang ..... B25C 1/005 227/109
6,715,657 B2 * 4/2004 Chen ..... B25C 1/005 227/109
6,851,594 B1 * 2/2005 Huang ..... B25C 5/1658 227/109

(Continued)

*Primary Examiner* — Gloria R Weeks
(74) *Attorney, Agent, or Firm* — Alan D. Kamrath; Kamrath IP Lawfirm, P.A.

(57) ABSTRACT

A nail pushing device of a nail gun includes a base connected to the nose of the nail gun, a cover slidably connected to the base, and restriction units received in the cover. The base has multiple positioning slots, slide slots and passages. The restriction units are installed in the positioning slots and each have a main part for being contact with the nails. The main part of each restriction unit has a ridge protruding laterally therefrom and a resilient leg extends from each of two ends of the ridge. The restriction units each have a guide member and an engaging portion on two ends thereof. The restriction units located in the positioning slots at different positions are used to guide nails of different lengths.

1 Claim, 6 Drawing Sheets

(56) References Cited

U.S. PATENT DOCUMENTS

| | | | | |
|---|---|---|---|---|
| 7,497,364 | B2 * | 3/2009 | Lee | B25C 1/005 227/109 |
| 7,520,413 | B1 * | 4/2009 | Cho | B25C 1/005 227/109 |
| 7,726,534 | B2 * | 6/2010 | Chou | B25C 1/005 227/109 |
| 9,527,196 | B2 * | 12/2016 | Segura | B25C 1/005 |
| 9,573,260 | B2 * | 2/2017 | Walters, Jr. | B25C 1/005 |
| 2008/0093410 | A1 * | 4/2008 | Canlas, Jr. | B25C 1/005 227/125 |
| 2008/0264999 | A1 * | 10/2008 | Lee | B25C 5/1658 227/109 |
| 2008/0296340 | A1 * | 12/2008 | Wang | B25C 5/1651 227/109 |
| 2010/0230463 | A1 * | 9/2010 | Yang | B25C 1/005 227/109 |

* cited by examiner

NAIL PUSHING DEVICE FOR NAIL GUN

BACKGROUND OF THE INVENTION

1. Fields of the invention

The present invention relates to a nail gun, and more particularly, to a nail pushing device of a nail gun, and the nail pushing device includes less number of parts and reduces the size of the magazine of the nail gun.

2. Descriptions of Related Art

The conventional magazine of a nail gun generally comprises a base with a cover connected thereto, and nails are received between the base and the cover. The cover includes an upper guide portion and a lower guide portion, a middle portion is formed between the upper and lower guide portions. The cover has a positioning portion on each end thereof such that the support members are fixed to the two ends of the cover. The support members each have a fixing portion and a restriction slot, wherein the fixing portion is directly or indirectly connected to the positioning portions of the cover. The restriction slot receives one end of a guide member. The two ends of the guide member are connected to the restriction slots of the support members on the two ends of the cover respectively. The push member has a spring and a push plate mounted thereto so that the spring and the push plate are movable along the direction of the guide member in the cover. Nevertheless, the combination of the push member, the spring, the push plate and the support members makes the magazine to be bulky, and the assembling processes take a lot of time.

The present invention intends to provide a nail pushing device of a nail gun to eliminate the shortcomings mentioned above.

SUMMARY OF THE INVENTION

The present invention relates to a nail pushing device of a nail gun and comprises a base connected to the nose of the nail gun. An upper groove and a lower groove are respectively defined in the inner side of the base. Multiple guide slots are defined in the inner side of the base and located between the upper groove and the lower groove. The upper groove, the lower groove and the guide slots are parallel to each other. A cover has an upper guide portion and a lower guide portion formed at the inner side thereof. The upper guide portion and the lower guide portion of the cover are slidably engaged with the upper groove and the lower groove of the base. Multiple positioning slots, multiple slide slots and multiple passages are defined in the inner side of the cover, and are located between the upper guide portion and the lower guide portion. The upper guide portion, the lower guide portion, the positioning slots, the slide slots and multiple passages are parallel to each other. The slide slots each have an end communicating with the passage corresponding thereto.

Multiple restriction units each have a main part, a ridge protruding from one side of the main part, and a leg extends laterally from each of two ends of the ridge so as to form a gap between each of the legs and the main part. The restriction units are engaged with the positioning slots respectively. The main part contacts or restricts nails between the base and the cover. Each restriction unit has a guide member extending from the front end thereof, the guide member is inserted into the nail entrance of the nose. An engaging portion protrudes from the rear end of each restriction unit and is engaged with the cover. A push plate has a wing extending from each of two sides thereof. Each of the two wings is inserted into the slide slot and the passage corresponding thereto. A spring and a push rod are received in each of the passages so as to push the push plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
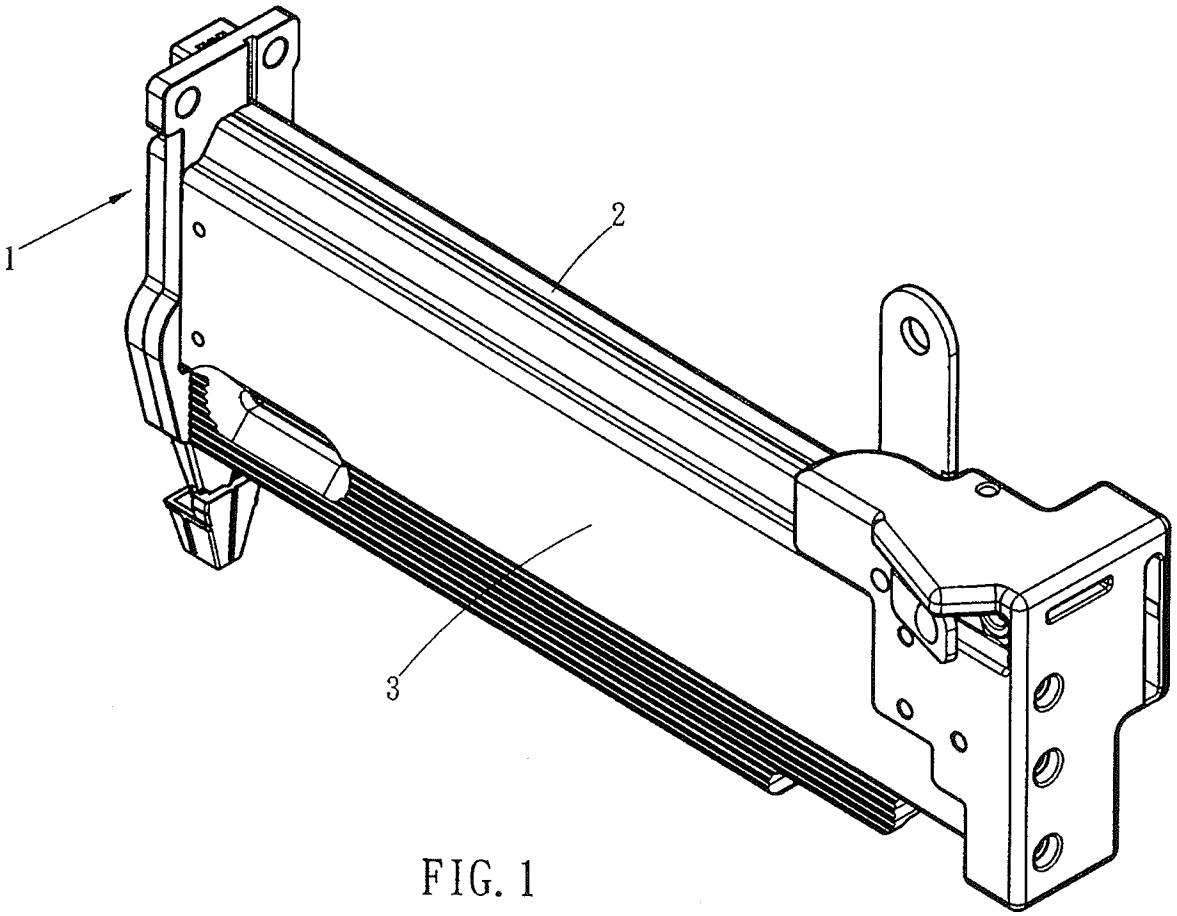
FIG. 1 is a perspective view to show the magazine connected to a nose of a nail gun with the nail pushing device of the present invention installed in the magazine.

Referring to FIGS. 1 to 7, the nail pushing device of a nail gun of the present invention comprises a base 2 which is connected to the nose 1 of the nail gun. The base 20 has an upper groove 20 and a lower groove 21 respectively defined in the inner side thereof. Multiple guide slots 22 are defined in the inner side of the base 2 and located between the upper groove 20 and the lower groove 21. The upper groove 20, the lower groove 21 and the guide slots 22 are parallel to each other.

A cover 3 has an upper guide portion 30 and a lower guide portion 31 formed at the inner side thereof. The upper guide portion 30 and the lower guide portion 31 of the cover 3 are slidably engaged with the upper groove 20 and the lower groove 21 of the base 2 as shown in FIG. 2.

Multiple positioning slots 32, multiple slide slots 33 and multiple passages 34 are defined in the inner side of the cover 3, and located between the upper guide portion 30 and the lower guide portion 31. The upper guide portion 30, the lower guide portion 31, the positioning slots 32, the slide slots 33 and multiple passages 34 are parallel to each other. The slide slots 33 each have an end communicating with the passage 34 corresponding thereto.

Figure 2:
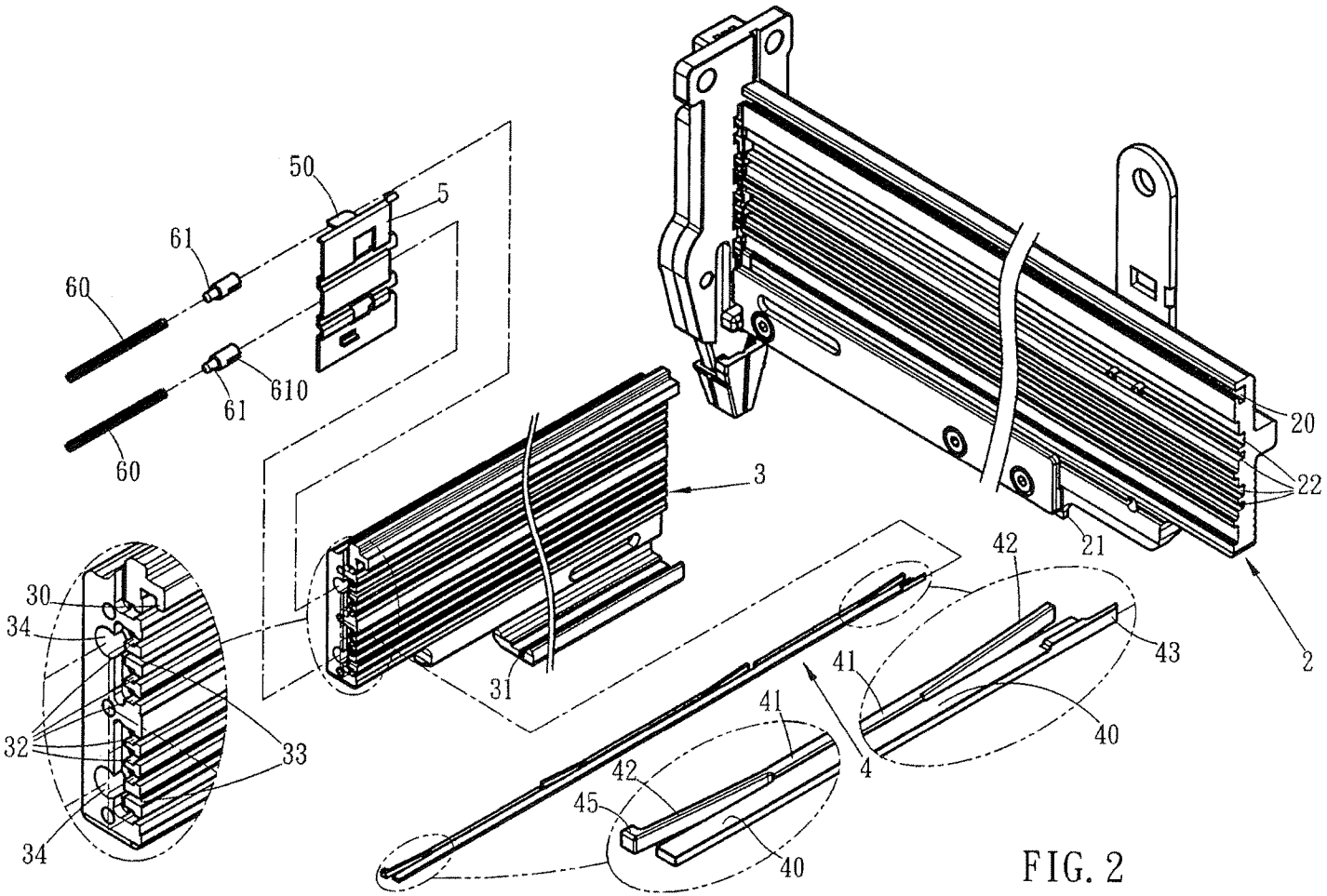
FIG. 2 is an exploded view of the nail pushing device of the present invention of the present invention.
Figure 6:
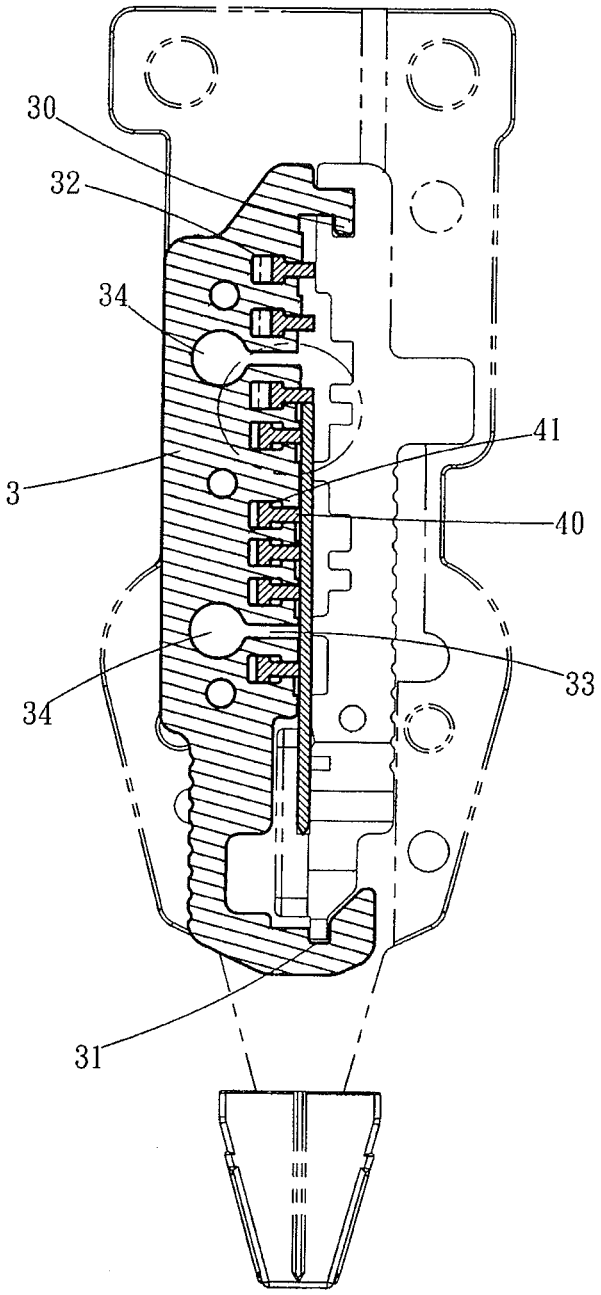
FIG. 6 is an end cross sectional view of the disclosure of FIG. 3.

Multiple restriction units 4 each have a main part 40, a ridge 41 protruding from one side of the main part 40, and a leg 42 extending laterally from each of two ends of the ridge 41 so as to form a gap between each of the legs 42 and the main part 40 as shown in FIGS. 2 and 6. The restriction units 4 are engaged with the positioning slots 32 respectively. The main part 40 is in contact with or restricts nails 7 between the base 2 and the cover 3. Each restriction unit 4 has a guide member 43 extending from the front end thereof, the guide member 43 is inserted into a nail entrance 10 of the nose 1 so as to guide the nails 7 in the magazine (the base 2 and the cover 3) to be entered into the mail path 11 of the nose 1. An engaging portion 45 protrudes from the rear end of each restriction unit 4 and is engaged with the cover 3.

Figure 3:
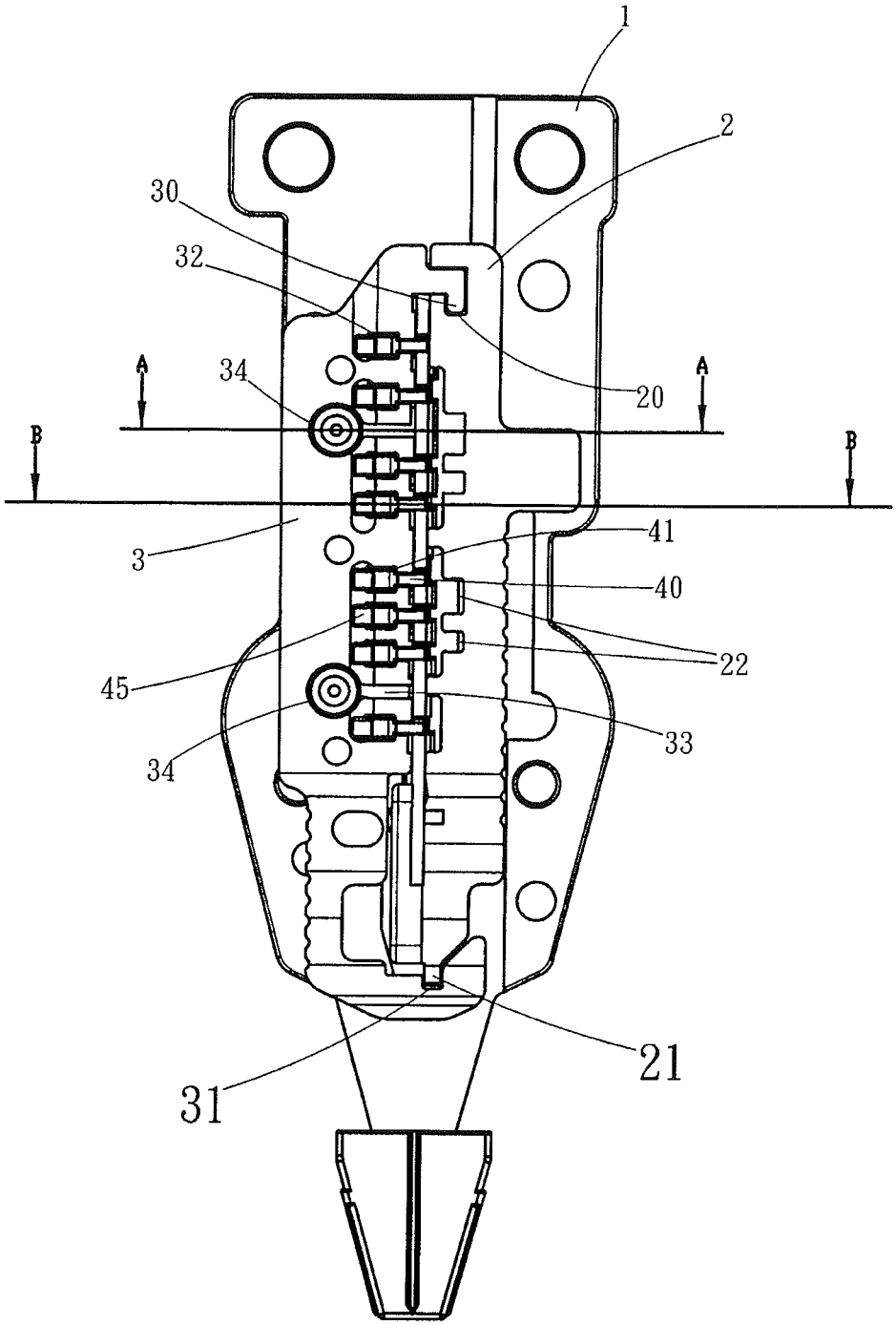
FIG. 3 is an end view of the nail pushing device of the present invention of the present invention.
Figure 4:
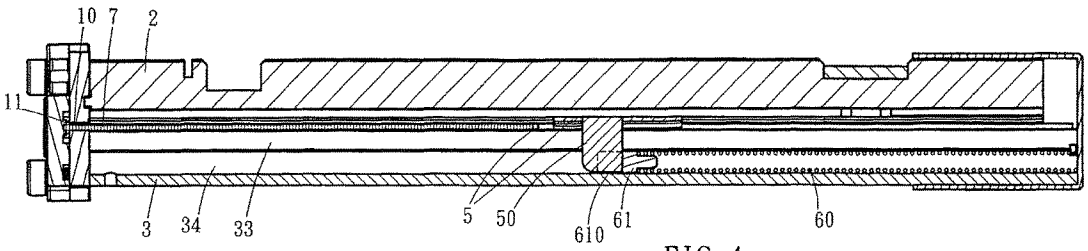
FIG. 4 is a cross sectional view, taken along line A-A of FIG. 3.
Figure 5:
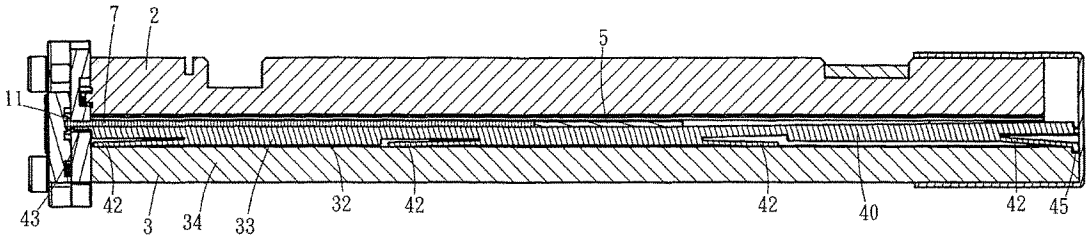
FIG. 5 is a cross sectional view, taken along line B-B of FIG. 3.

A push plate 5 has a wing 50 extending from each of two sides thereof. Each of the two wings 50 is inserted into the slide slot 33 and the passage 34 corresponding thereto. A spring 60 and a push rod 61 are received in each of the passages 34 so as to push the push plate 5 to different positions as shown in FIGS. 2, 3 and 6. The push rods 61 each have a slot 610 in which the wing 50 is inserted. The push rods 61 move the push plate 5.

When in assembly, the restriction units 4 are installed to the positioning slots 32 of the cover 3, and the ridges 41 and the legs 42 are in contact with the inside of the positioning slots 32. The engaging portions 45 are connected to the cover 3. The nails 7 are installed to the inside of the base 2 and the cover 3 is then slidably connected to the base 2.

Figure 7:
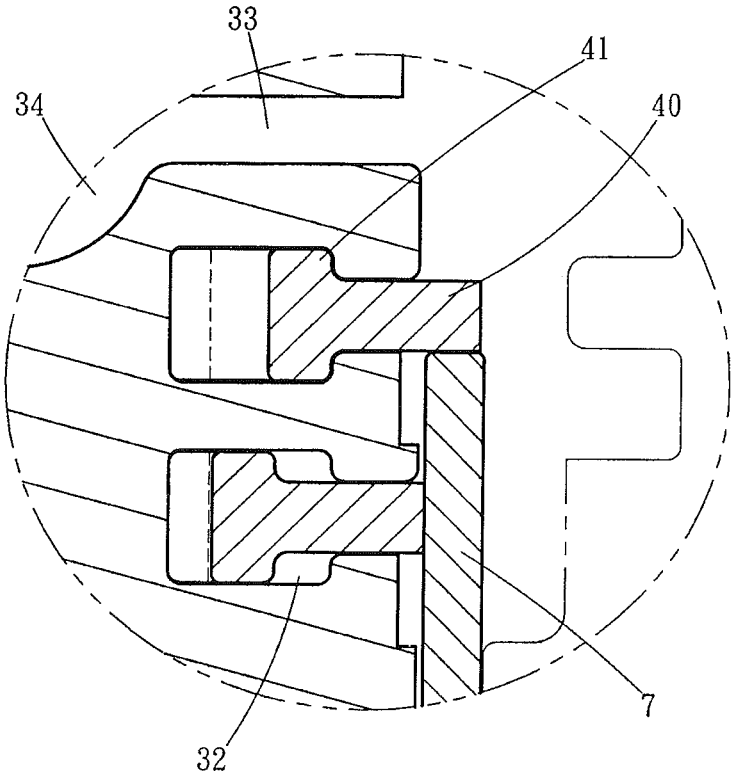
FIG. 7 is an enlarged view of the circled portion in FIG. 6.

When the nails 7 are short, the base part 40 of the restriction unit 4 in the upper most positioning slot 32 of the cover 3 slightly protrudes beyond the surface of the positioning slot 32, and the nail 7 presses the main part 40 so that the main part 40 is compressed toward the leg 42 of the restriction unit 40 such that the gap between the main part 40 and the leg 42 is narrowed, or the surface of the main part 40 does not protrude beyond the positioning slot 32. As shown in FIG. 7, the restriction unit 4 that is not pressed by the nail 7 will be located above the nail 7 to restrict the nail 7 to be further pushed upward by the push plate 5. In the meanwhile, one side of the main part 40 of the restriction unit 4 that is pressed by the nail 7 will contact the lateral side of the nail 7 to guide and position the nail 7 as shown in FIG. 6.

While we have shown and described the embodiment in accordance with the present invention, it should be clear to those skilled in the art that further embodiments may be made without departing from the scope of the present invention.

What is claimed is:

1. A nail pushing device of a nail gun, comprising:

a base adapted to be connected to a nose of the nail gun, an upper groove and a lower groove respectively defined in an inner side of the base, multiple guide slots defined in the inner side of the base and located between the upper groove and the lower groove, the upper groove, the lower groove and the guide slots being parallel to each other;

a cover having an upper guide portion and a lower guide portion formed at an inner side thereof, the upper guide portion and the lower guide portion of the cover slidably engaged with the upper groove and the lower groove of the base, multiple positioning slots, multiple slide slots and multiple passages defined in the inner side of the cover, and located between the upper guide portion and the lower guide portion, the upper guide portion, the lower guide portion, the positioning slots, the slide slots and multiple passages being parallel to each other, the slide slots each having an end communicating with the passage corresponding thereto;

multiple restriction units each having a main part, a ridge protruding from one side of the main part, and a leg extending laterally from each of two ends of the ridge so as to form a gap between each of the legs and the main part, the restriction units engaged with the positioning slots respectively, the main part adapted to contact or restrict nails between the base and the cover, each restriction unit having a guide member extending from a front end thereof, the guide member adapted to be inserted into a nail entrance of the nose, an engaging portion protruding from a rear end of each restriction unit and being engaged with the cover, and a push plate having a wing extending from each of two sides thereof, each of the two wings inserted into the slide slot and the passage corresponding thereto, a spring and a push rod received in each of the passages so as to push the push plate.

* * * * *